US011392159B2

(12) United States Patent
Liang et al.

(10) Patent No.: US 11,392,159 B2
(45) Date of Patent: Jul. 19, 2022

(54) SHUTDOWN MODE FOR BANDGAP REFERENCE TO REDUCE TURN-ON TIME

(71) Applicant: SKYWORKS SOLUTIONS, INC., Irvine, CA (US)

(72) Inventors: Bang Li Liang, Ottawa (CA); Gabriel Bogdan Gheorghiu, Ottawa (CA)

(73) Assignee: SKYWORKS SOLUTIONS, INC., Irvine, CA (US)

( * ) Notice: Subject to any disclaimer, the term of this patent is extended or adjusted under 35 U.S.C. 154(b) by 0 days.

(21) Appl. No.: 17/225,657

(22) Filed: Apr. 8, 2021

(65) Prior Publication Data

US 2021/0318708 A1 Oct. 14, 2021

Related U.S. Application Data

(60) Provisional application No. 63/008,148, filed on Apr. 10, 2020.

(51) Int. Cl.

| | |
|---|---|
| ***G05F 3/30*** | (2006.01) |
| ***G05F 3/26*** | (2006.01) |
| ***G05F 3/20*** | (2006.01) |

(52) U.S. Cl.

CPC ..... *G05F 3/262* (2013.01); *G05F 3/205* (2013.01); *G05F 3/30* (2013.01)

(58) Field of Classification Search

None

See application file for complete search history.

(56) References Cited

U.S. PATENT DOCUMENTS

| | | | | |
|---|---|---|---|---|
| 7,602,236 | B2 * | 10/2009 | Jo | G05F 3/30 327/539 |
| 8,008,966 | B2 * | 8/2011 | Cho | G05F 3/30 327/539 |
| 8,704,588 | B2 * | 4/2014 | Conte | H03F 3/45183 327/539 |
| 10,522,196 | B2 * | 12/2019 | Yang | H03F 3/72 |
| 11,127,437 | B2 * | 9/2021 | Lin | H03F 1/301 |

(Continued)

FOREIGN PATENT DOCUMENTS

| | | | |
|---|---|---|---|
| KR | 10-2009-0048295 | A | 5/2009 |
| WO | 2007035724 | A2 | 3/2007 |
| WO | 2017093911 | A1 | 6/2017 |

OTHER PUBLICATIONS

International Search Report and Written Opinion from corresponding International Application No. PCT/US2021/026404 dated Jul. 23, 2021.

*Primary Examiner* — Jeffery S Zweizig

(74) *Attorney, Agent, or Firm* — Lando & Anastasi, LLP

(57) ABSTRACT

Examples of the disclosure include a controller having a mode of operation including one of an on mode and an off mode, the controller including a voltage rail node, a reference node, at least one powered component configured to generate a bandgap voltage signal based on a rail voltage at the voltage rail node, a switching device coupled in series between the reference node and the at least one powered component and configured to provide a conductive path through the at least one powered component from the voltage rail node to the reference node in response to the controller being in the on mode, and to interrupt the conductive path through the at least one powered component in response to the controller being in the off mode.

16 Claims, 4 Drawing Sheets

(56) References Cited

U.S. PATENT DOCUMENTS

| | | | | |
|---|---|---|---|---|
| 2004/0257150 | A1 | 12/2004 | Farooqui | |
| 2017/0160763 | A1* | 6/2017 | Barbelenet | G05F 1/468 |
| 2019/0025868 | A1 | 1/2019 | Segarra | |
| 2020/0401177 | A1* | 12/2020 | Liang | G05F 3/30 |
| 2021/0132642 | A1 | 5/2021 | Liang et al. | |

* cited by examiner

SHUTDOWN MODE FOR BANDGAP REFERENCE TO REDUCE TURN-ON TIME

CROSS-REFERENCE TO RELATED APPLICATIONS

This application claims priority under 35 U.S.C. § 119(e) to U.S. Provisional Application Ser. No. 63/008,148, titled "SHUTDOWN MODE FOR BANDGAP REFERENCE TO REDUCE TURN-ON TIME," filed on Apr. 10, 2020, which is hereby incorporated by reference in its entirety.

BACKGROUND

1. Field of the Disclosure

At least one example in accordance with the present disclosure relates generally to reducing leakage current and a turn-on time of a bandgap reference generator.

2. Discussion of Related Art

The Internet of Things (IoT) refers to a system of interrelated devices, including computing devices, that are capable of communicating via a network, such as the Internet. IoT devices may communicate pursuant to radio technology standards, such as the Narrowband Internet of Things (NB-IoT) low power wide area network radio technology standard. Certain narrowband categories are defined by NB-IoT, such as Cat NB1. Devices implemented in Cat NB1 applications may be subject to strict design requirements, including low off-state current requirements and fast wakeup time requirements.

SUMMARY

According to at least one aspect of the present disclosure, a controller having a mode of operation including one of an on mode and an off mode is provided, the controller including a voltage rail node, a reference node, at least one powered component configured to generate a bandgap voltage signal based on a rail voltage at the voltage rail node, and a switching device coupled in series between the reference node and the at least one powered component and configured to provide a conductive path through the at least one powered component from the voltage rail node to the reference node in response to the controller being in the on mode, and to interrupt the conductive path through the at least one powered component in response to the controller being in the off mode.

In some examples, the at least one powered component is coupled between the switching device and the voltage rail node. In various examples, the switching device is further configured to maintain the at least one powered component at the rail voltage in the off mode. In at least one example, the switching device includes a metal-oxide semiconductor field-effect transistor (MOSFET). In some examples, the MOSFET includes a drain coupled to the at least one powered component, a source coupled to the reference node, and a gate to receive a signal indicative of the mode of operation of the controller. In various examples, the MOSFET is configured to conduct a leakage current of less than 10 nA in the off mode.

In at least one example, the at least one powered component includes one or more of a bandgap reference core, an error amplifier, and a bias voltage generator. In some examples, the at least one powered component is configured to generate one or more of the bandgap voltage signal, a power amplifier bias signal, and a regulator bias current signal. In various examples, the controller further includes at least one of a power amplifier and a low-dropout regulator. In at least one example, the controller includes the power amplifier and the low-dropout regulator, and the at least one powered component is configured to provide the power amplifier bias signal to the power amplifier, the regulator bias current signal to the low-dropout regulator, and the bandgap voltage signal to the power amplifier and the low-dropout regulator. In some examples, the bandgap reference core, the error amplifier, and the bias voltage generator are coupled in parallel.

According to at least one aspect of the present disclosure, a method of operating a controller having a voltage rail node, a reference node, at least one powered component, and a switching device coupled in series between the at least one powered component and the reference node is provided, the method comprising receiving a rail voltage at the voltage rail node, controlling the switching device to prevent a current from passing through the at least one powered component while the controller is in an off mode, maintaining the at least one powered component at the rail voltage while the controller is in the off mode, and controlling the switching device to provide a current through the at least one powered component from the voltage rail node to the reference node while the controller is in an on mode.

In some examples, the switching device includes a metal-oxide semiconductor field-effect transistor (MOSFET), and wherein controlling the switching device to prevent a current from passing through the at least one powered component while the controller is in the off mode includes controlling the MOSFET to be in an open and non-conducting position. In various examples, controlling the switching device to provide a current through the at least one powered component from the voltage rail node to the reference node while the controller is in the on mode includes controlling the MOSFET to be in a closed and conducting position. In at least one example, maintaining the at least one powered component at the rail voltage includes maintaining a connection between the voltage rail node and the at least one powered component while the MOSFET is in the open and non-conducting position. In some examples, the method includes controlling the at least one powered component to generate a bandgap voltage signal based on the rail voltage. In various examples, the method includes providing the bandgap voltage signal to one or more external components. In at least one example, controlling the switching device to prevent a current from passing through the at least one powered component includes limiting a leakage current to less than 10 nA.

According to at least one aspect of the present disclosure, a bandgap reference voltage system is provided comprising an input configured to be coupled to a voltage rail node, at least one powered component configured to generate a bandgap voltage signal based on a rail voltage at the voltage rail node, and a switching device coupled in series between the at least one powered component and a reference node, and being configured to provide, while in an on mode, a conductive path through the at least one powered component from the voltage rail node to the reference node, and interrupt, while in an off mode, the conductive path through the at least one powered component.

In some examples, the switching device includes a metal-oxide semiconductor field-effect transistor (MOSFET), and wherein the MOSFET is configured to be closed and conducting in the on mode and open and non-conducting in the off mode.

BRIEF DESCRIPTION OF THE DRAWINGS

Various aspects of at least one embodiment are discussed below with reference to the accompanying figures, which are not intended to be drawn to scale. The figures are included to provide an illustration and a further understanding of the various aspects and embodiments, and are incorporated in and constitute a part of this specification, but are not intended as a definition of the limits of any particular embodiment. The drawings, together with the remainder of the specification, serve to explain principles and operations of the described and claimed aspects and embodiments. In the figures, each identical or nearly identical component that is illustrated in various figures is represented by a like numeral. For purposes of clarity, not every component may be labeled in every figure. In the figures:

DETAILED DESCRIPTION

Figure 1:
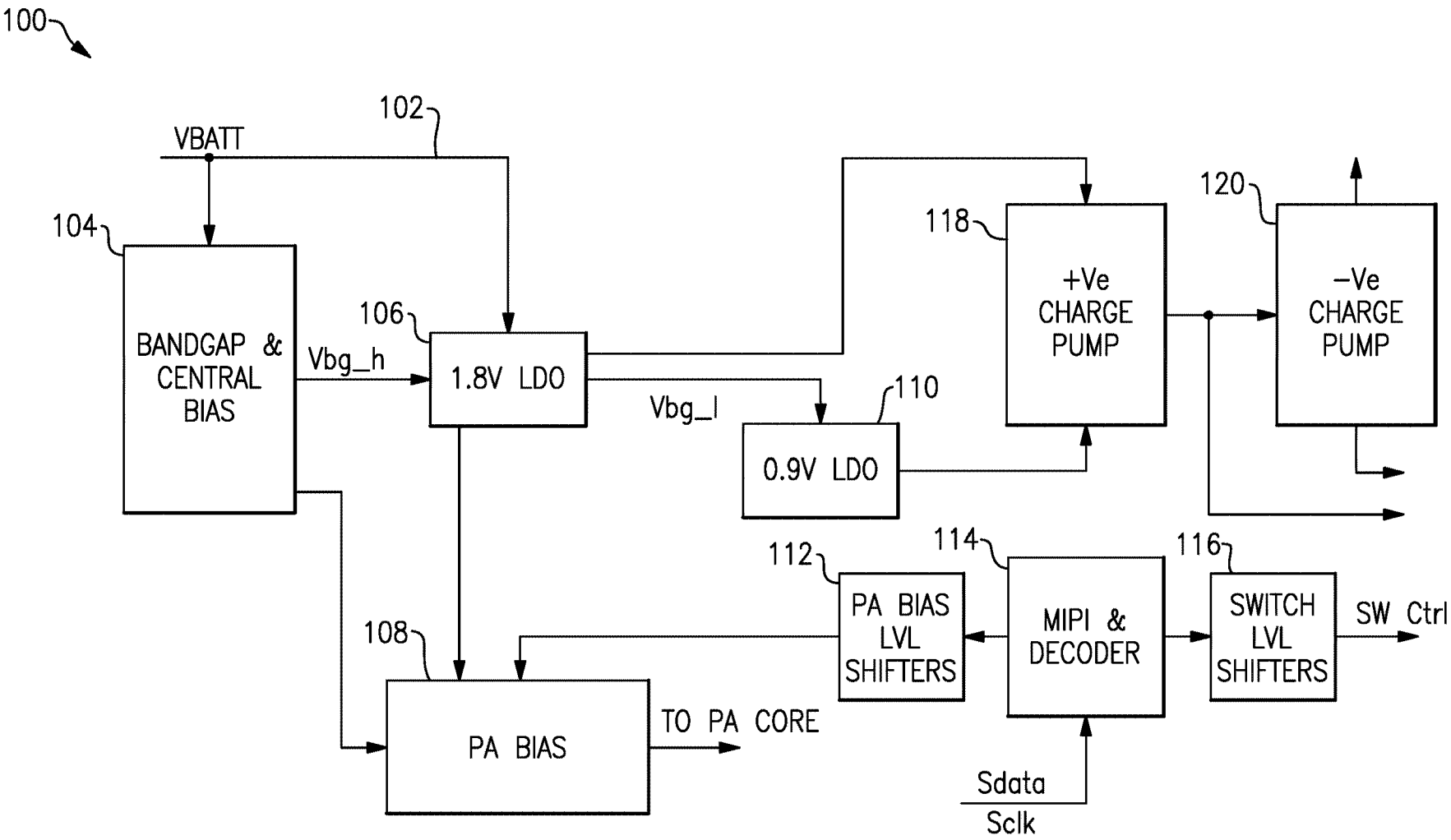
FIG. 1 illustrates a block diagram of a controller according to an example.

Examples of the methods and systems discussed herein are not limited in application to the details of construction and the arrangement of components set forth in the following description or illustrated in the accompanying drawings. The methods and systems are capable of implementation in other embodiments and of being practiced or of being carried out in various ways. Examples of specific implementations are provided herein for illustrative purposes only and are not intended to be limiting. In particular, acts, components, elements and features discussed in connection with any one or more examples are not intended to be excluded from a similar role in any other examples.

Also, the phraseology and terminology used herein is for the purpose of description and should not be regarded as limiting. Any references to examples, embodiments, components, elements or acts of the systems and methods herein referred to in the singular may also embrace embodiments including a plurality, and any references in plural to any embodiment, component, element or act herein may also embrace embodiments including only a singularity. References in the singular or plural form are no intended to limit the presently disclosed systems or methods, their components, acts, or elements. The use herein of "including," "comprising," "having," "containing," "involving," and variations thereof is meant to encompass the items listed thereafter and equivalents thereof as well as additional items.

References to "or" may be construed as inclusive so that any terms described using "or" may indicate any of a single, more than one, and all of the described terms. In addition, in the event of inconsistent usages of terms between this document and documents incorporated herein by reference, the term usage in the incorporated features is supplementary to that of this document; for irreconcilable differences, the term usage in this document controls.

As discussed above, devices implemented in Cat NB1 low-data-rate applications may be subject to strict design requirements. For example, controllers implemented in Cat NB1 low-data-rate applications may have ultra-low off-state current requirements and fast wakeup time requirements from an off state to a transmitting (TX) or receiving (RX) state. In one example, an off-state current requirement may be limited to less than 400 nA in a nominal case, and less than 1 μA over process, voltage, and temperature (PVT). In another example, a wakeup time requirement from an off state to a TX or RX state may be limited to less than 30 μs. In still another example, an RX state current may be limited to less than 700 μA.

Generally speaking, a wakeup time of a device may be inversely proportional to a current consumed by the device. Accordingly, decreasing a device's off-state current may be in tension with reducing the wakeup time of the device. Thus, adhering to the design requirements of controllers implemented in Cat NB1 low-data-rate applications may be difficult where wakeup time and off-state current are in tension.

Accordingly, it may be beneficial to provide a controller that is capable of providing both an ultra-low off-state current and fast wakeup times discussed above. In one example, a controller implements a shutdown operation to physically shut down current paths throughout the controller which might otherwise conduct high off-state leakage currents. For example, such current paths may include certain modules or components that otherwise might conduct high leakage off-state currents, such as a bandgap reference block including a bandgap reference voltage generator and/or a proportional-to-absolute-temperature (PTAT) reference current generator.

In one example, a switching circuit is implemented in a current path connecting a bandgap reference block to a power source. The switching circuit is configured to control a current between the power source and the bandgap reference block. In a first mode (for example, a mode in which the bandgap reference block is to be activated), the switching circuit is in a closed and conducting position to provide a current to the bandgap reference block. In a second mode (for example, a mode in which the bandgap reference block is to be deactivated), the switching circuit is in an open and non-conducting position to limit a leakage current from being provided to the bandgap reference block. For example, the leakage current may be limited to less than 10 nA where the switching circuit is in the second mode.

In various examples, the switching circuit may be coupled between the bandgap reference block and a reference node (for example, a neutral node). The bandgap reference block, in turn, may be configured to be coupled between the switching circuit and a voltage source.

Accordingly, where the switching circuit is in the second mode and the bandgap reference block thus conducts a negligible leakage current, the bandgap reference block may be at a voltage level of the voltage source to which the bandgap reference block is connected. A transition time from the deactivated mode to the activated mode may thus be advantageously decreased, because it may be faster to transition from the voltage level of the voltage source to an operating voltage level of the bandgap reference block than from a reference voltage (for example, a neutral voltage) to the operating voltage level of the bandgap reference block. Accordingly, implementation of the switching circuit may advantageously limit a leakage current of the switching circuit while simultaneously minimizing a transition time from the deactivated mode of the bandgap reference block to the activated mode of the bandgap reference block.

FIG. 1 illustrates a block diagram of a controller 100 according to an example. For example, the controller 100 may be implemented in a Cat NB1 low-data-rate application. The controller 100 includes a voltage rail 102, a bandgap reference block 104, a high-voltage low-dropout (LDO) regulator 106, a power amplifier (PA) bias generator 108, a low-voltage LDO 110, PA bias level shifters 112, a mobile industry processor interface (MIPI) and decoder 114, switch level shifters 116, a positive-voltage charge pump 118, and a negative-voltage charge pump 120.

The voltage rail 102 is coupled to the bandgap reference block 104 and the high-voltage LDO regulator 106, and is configured to be coupled to a voltage source (for example, a battery) to provide power to the bandgap reference block 104 and the high-voltage LDO regulator 106. The bandgap reference block 104 is coupled to the voltage rail 102 at an input, and is coupled to the high-voltage LDO regulator 106 and the PA bias generator 108 at one or more outputs to provide one or more output signals. The high-voltage LDO regulator 106 is coupled to the voltage rail 102 and the bandgap reference block 104 at one or more inputs, and is coupled to the PA bias generator 108, the low-voltage LDO 110, and the positive-voltage charge pump 118.

The PA bias generator 108 is coupled to the bandgap reference block 104, the high-voltage LDO regulator 106, and the PA bias level shifters 112 at respective inputs, and is coupled to a PA core (not illustrated) at an output. The low-voltage LDO 110 is coupled to the high-voltage LDO regulator 106 at an input, and is coupled to the positive-voltage charge pump 118 at an output. The PA bias level shifters 112 are coupled to the MIPI and decoder 114 at an input, and is coupled to the PA bias generator 108 at an output. The MIPI and decoder 114 are coupled to the PA bias level shifters 112 and the switch level shifters 116 at an output, and are configured to receive a data signal and a clock signal at an input. The switch level shifters 116 are coupled to the MIPI and decoder 114 at an input, and are configured to provide a switch control signal at an output.

The positive-voltage charge pump 118 is coupled to the high-voltage LDO regulator 106 and the low-voltage LDO 110 at an input, and is configured to provide a positive voltage (for example, at 2.5 V) to one or more entities (for example, including the negative-voltage charge pump 120) at an output. The negative-voltage charge pump 120 is coupled to the positive-voltage charge pump 118 at an input, and is configured to provide a negative voltage (for example, at −2.5 V) to one or more entities at an output.

Figure 2:
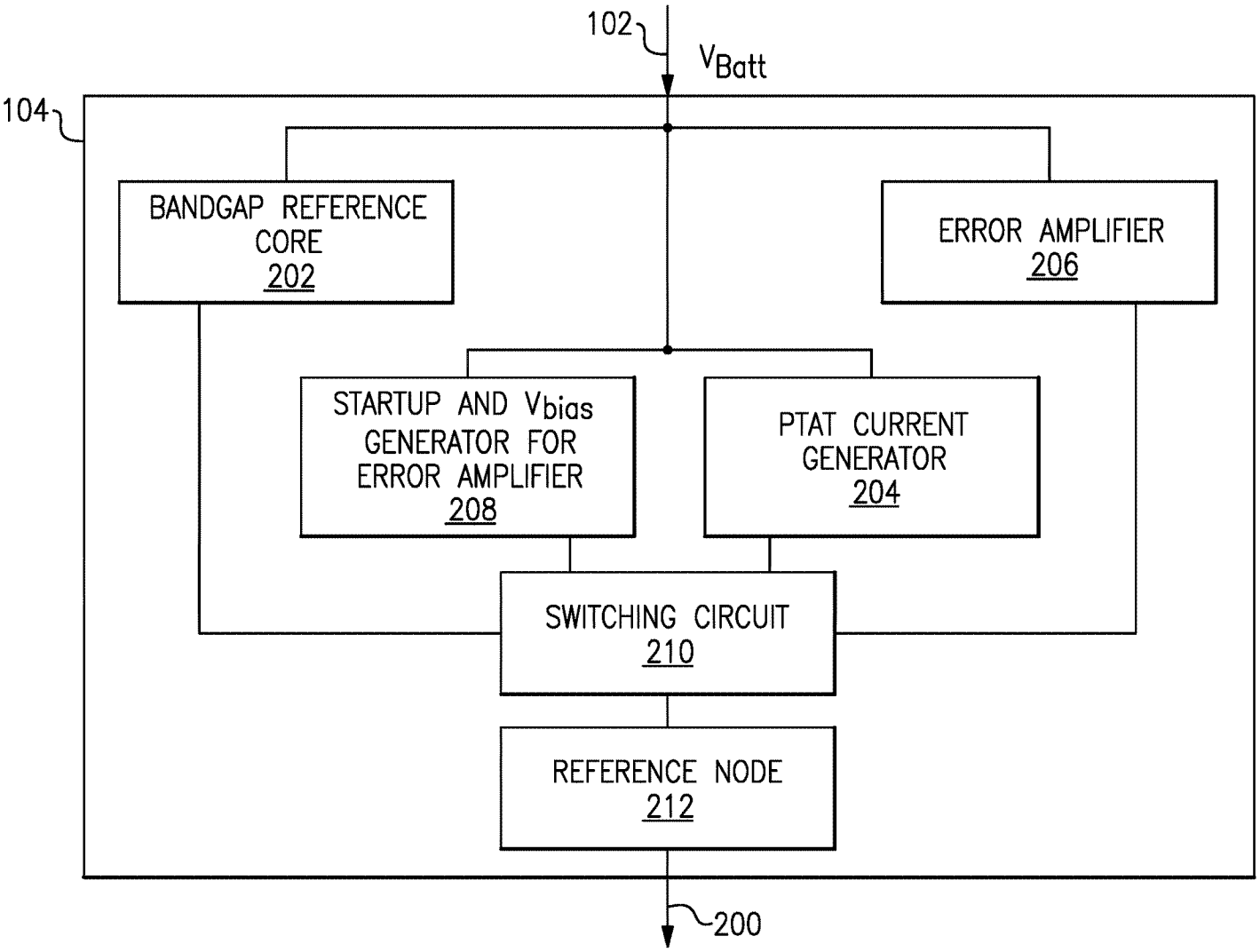
FIG. 2 illustrates a block diagram of a bandgap reference block according to an example.

As discussed in greater detail below with respect to FIG. 2, the bandgap reference block 104 is configured to receive a rail voltage from the voltage rail 102 and generate one or more output signals based on the rail voltage. For example, the one or more output signals may include one or more of a PA bias current signal, a low-voltage LDO bias current signal, a high-voltage LDO bias current signal, and a bandgap reference voltage signal. The one or more output signals, including the bandgap reference voltage signal, may be provided to the high-voltage LDO regulator 106 and the PA bias generator 108. The high-voltage LDO regulator 106 regulates the bandgap reference voltage signal to generate a high-voltage regulated voltage signal, and provides the high-voltage regulated voltage signal to the PA bias generator 108 and the low-voltage LDO regulator 110.

The PA bias generator 108 generates a bias signal based on the one or more output signals received from the bandgap reference block 104 and the high-voltage regulated voltage signal received from the high-voltage LDO 106, and provides the bias signal to the PA core (not illustrated). The low-voltage LDO regulator 110 is configured to receive the high-voltage regulated voltage signal from the high-voltage LDO regulator 106, generates a low-voltage regulated voltage signal based on the high-voltage regulated voltage signal, and provides the low-voltage regulated voltage signal to the positive-voltage charge pump 118. The positive-voltage charge pump 118 is configured to receive the low-voltage regulated voltage signal and the high-voltage regulated voltage signal, generate a positive voltage (for example, 2.5 V) based on the low-voltage regulated voltage signal and the high-voltage regulated voltage signal, and provide the positive voltage to one or more entities including the negative-voltage charge pump 120. The negative-voltage charge pump 120 is configured to receive the positive voltage, generate a negative voltage (for example,−2.5 V) based on the positive voltage, and provide the negative voltage to one or more entities, which may be the same or different entities than those to which the positive-voltage charge pump 118 provides the positive voltage.

Accordingly, at least some of the components of the controller 100 operate based on signals received directly or indirectly from the bandgap reference block 104. FIG. 2 illustrates a block diagram of the bandgap reference block 104 in greater detail according to an example. The bandgap reference block 104 is configured to receive an input signal from the voltage rail 102 and provide one or more output signals 200 based at least in part on the input signal. For example, the one or more output signals 200 may include a PA bias current signal, a low-voltage LDO bias current signal, a high-voltage LDO bias current signal, and/or a bandgap reference voltage signal, and may be provided to one or more components including the high-voltage LDO regulator 106 and the PA bias generator 108.

The bandgap reference block 104 includes a bandgap reference core 202, a PTAT current generator 204, an error amplifier 206, a startup and bias voltage ($V_{bias}$) generator for error amplifier 208, a switching circuit 210, and a reference node 212 (for example, a node at a neutral reference voltage). The bandgap reference core 202, the PTAT current generator 204, the error amplifier 206, and the startup and bias voltage ($V_{bias}$) generator for error amplifier 208 are coupled to the voltage rail 102 at a respective input, and are coupled to the switching circuit 210 at a respective output. The switching circuit 210 is coupled between the bandgap reference core 202, the PTAT current generator 204, the error amplifier 206, and the startup and bias voltage ($V_{bias}$) generator for error amplifier 208 and the reference node 212.

The switching circuit 210 is configured to operate in one of a closed and conducting position and an open and non-conducting position. When the switching circuit 210 is in the closed and conducting position, power is provided to each of the components 202-208 through a conductive path from the voltage rail 102 to the reference node 212 through the switching circuit 210. When the switching circuit 210 is in an open and non-conducting position, a significant amount of power is not provided to the components 202-208 at least because the conductive path from the voltage rail 102 to the reference node 212 is interrupted by the switching circuit 210. Thus, when the switching circuit 210 is in the open and non-conducting position (for example, where the bandgap reference block 104 is in a low-power, or deactivated, mode), power consumption by the bandgap reference block 104 is minimized. For example, a leakage current in the bandgap reference block 104 may be limited to less than 10 nA where the switching circuit 210 is in the open and non-conducting position.

Furthermore, where the bandgap reference block 104 is in a low-power mode and the switching circuit 210 is in the open and non-conducting position, the components 202-208 are connected to the voltage rail 102 and disconnected from the reference node 212. Accordingly, the components 202-208 may be maintained at the voltage of the voltage rail 102 while the switching circuit 210 is in the open and non-conducting position. When the bandgap reference block 104 transitions from the low-power mode to an active mode (for example, where the controller 100 transitions to a transmitting and/or receiving mode), the bandgap reference block 104 may be able to quickly generate and output the one or more output signals 200 at least because the components 202-208 are at the rail voltage immediately before the bandgap reference block 104 transitions to the active mode. A voltage level of at least one of the output signals 200 may be at a value (for example, approximately 1.167 V) closer to the rail voltage (for example, approximately 1.8 V) than the reference voltage (for example, 0 V), such that a start-up time of the bandgap reference block 104 is minimized. Thus, the bandgap reference block 104 is able to output the one or more output signals 200 more quickly than if the bandgap reference block 104 had been at the neutral voltage prior to transitioning to the active mode.

Figure 3:
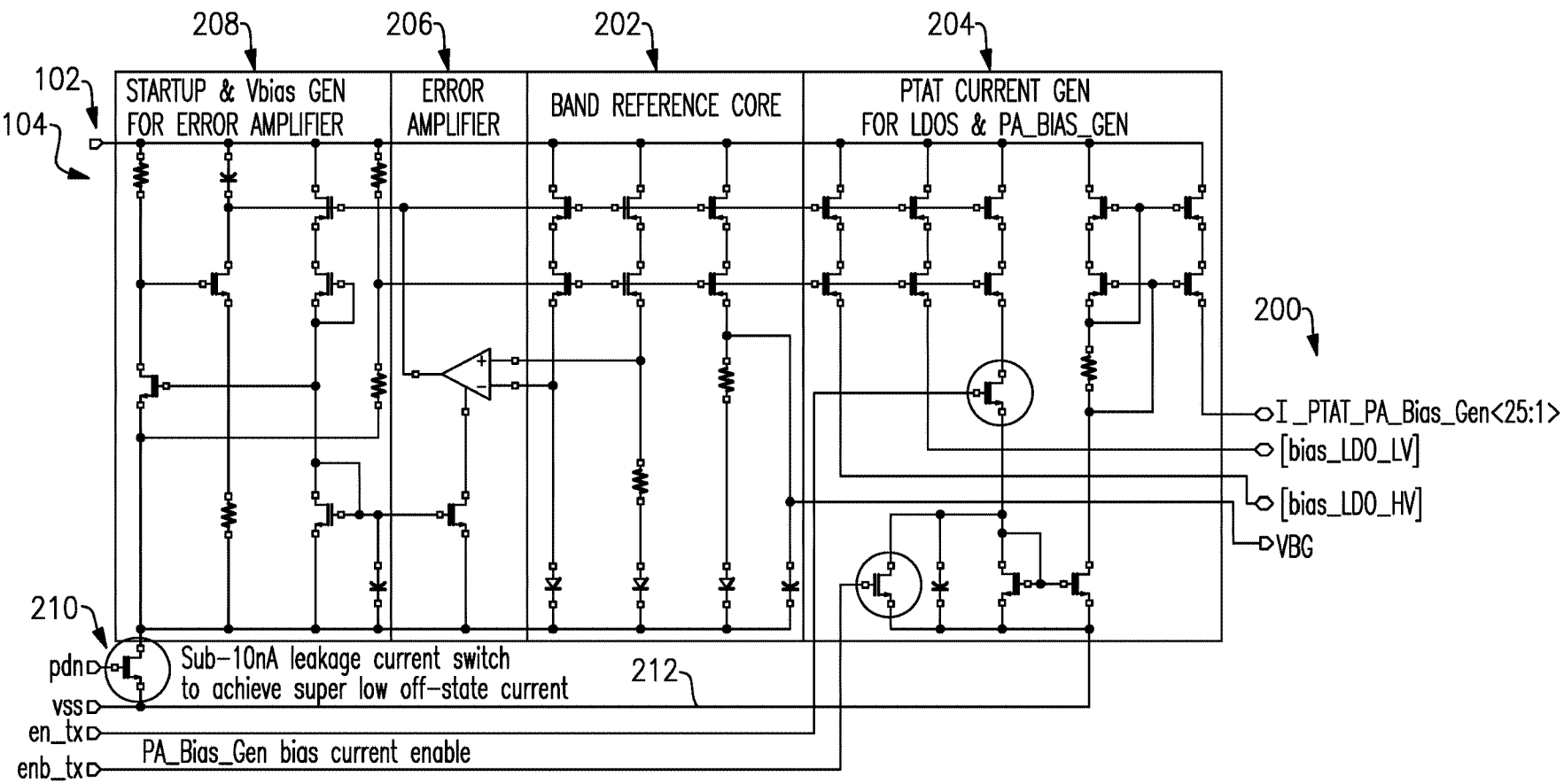
FIG. 3 illustrates a schematic diagram of a bandgap reference block according to an example.

FIG. 3 illustrates a schematic diagram of the bandgap reference block 104 according to an example. The bandgap reference block 104 includes the voltage rail 102, the one or more output signals 200, the bandgap reference core 202, the PTAT current generator 204, the error amplifier 206, and the startup and bias voltage ($V_{bias}$) generator for error amplifier 208, the switching circuit 210, and the reference node 212.

As illustrated in FIG. 3, in one example, the switching circuit 210 includes a metal-oxide semiconductor field-effect transistor (MOSFET) coupled between the components 202-208 and the reference node 212. More particularly, the MOSFET includes a drain connected to the components 202-208, a source connected to the reference node 212, and a gate configured to receive a power-up and/or power-down control signal. When the bandgap reference block 104 is in an active mode, the bandgap reference block 104 outputs the one or more control signals 200 including a PA bias current signal, a low-voltage LDO bias current signal, a high-voltage LDO bias current signal, and/or a bandgap reference voltage signal, which may be provided to the high-voltage LDO regulator 106 and/or the PA bias generator 108.

Figure 4:
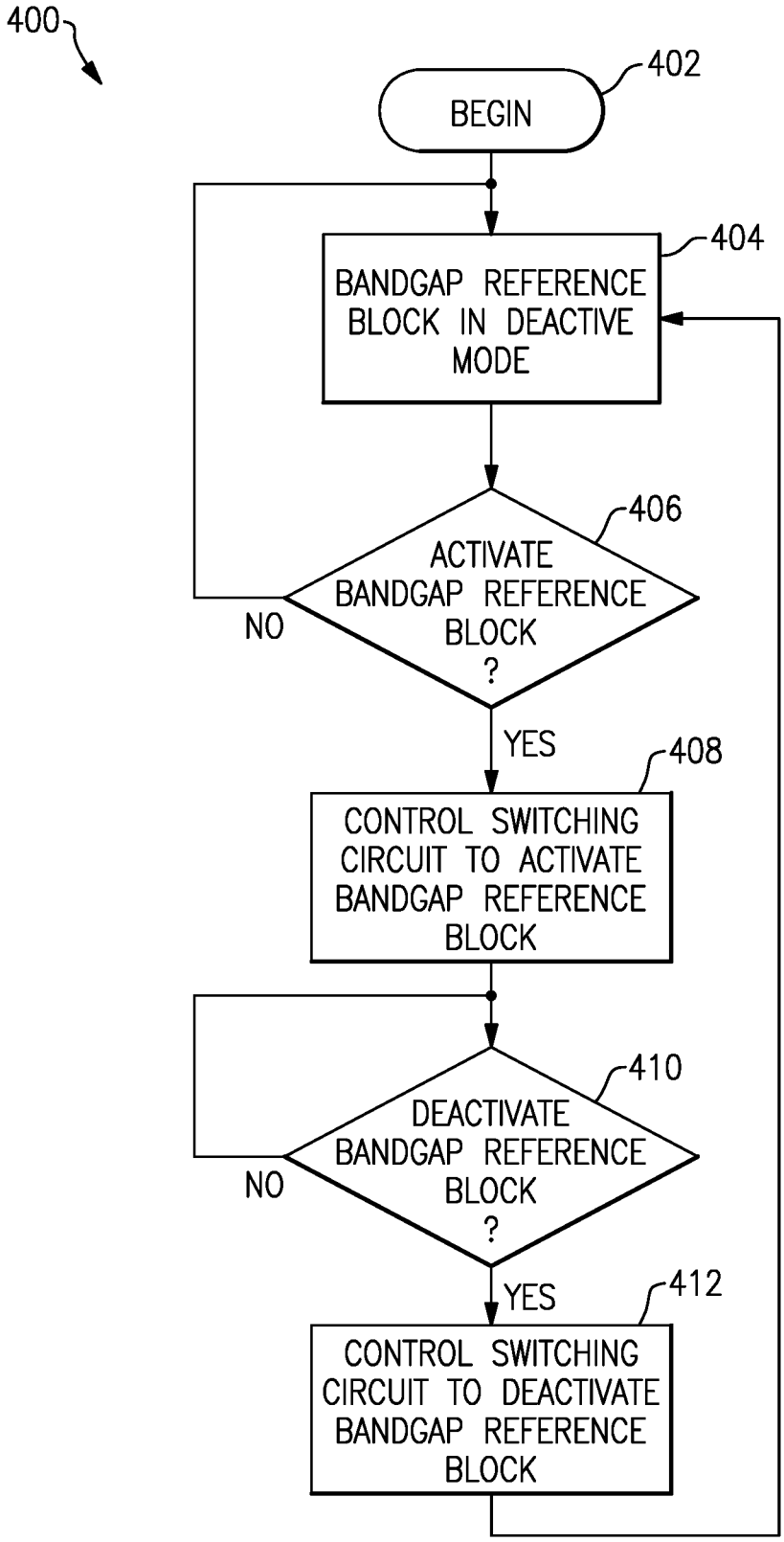
FIG. 4 illustrates a process of operating a bandgap reference block according to an example.

FIG. 4 illustrates a process 400 of operating the bandgap reference block 104 according to an example. For purposes of explanation, the process 400 is described as beginning where the bandgap reference block 104 is in a deactive mode.

At act 402, the process 400 begins.

At act 404, the bandgap reference block 104 is in a deactive mode. The bandgap reference block 104 may be in the deactive mode where the controller 100 is in a state in which operation of the bandgap reference block 104 is unnecessary. For example, the controller 100 may be in an idle state in which the controller 100 is not transmitting or receiving signals, such that generating and outputting the one or more output signals 200 is unnecessary.

At act 406, a determination is made as to whether to activate the bandgap reference block 104. For example, the bandgap reference block 104 may be activated where a power-up signal is received at a gate connection of a MOSFET in the switching circuit 210. If no power-up signal is received (406 NO), then the process 400 returns to act 404. Otherwise, if a power-up signal is received (406 YES), then the process 400 continues to act 408.

At act 408, the switching circuit 210 is controlled to activate the bandgap reference block 104. Activating the bandgap reference block 104 includes powering up the components 202-208. Responsive to receiving the power-up signal, the MOSFET may enter a closed and conducting position such that a conductive path is formed from the voltage rail 102 to the reference node 212 via the switching circuit 210, thereby powering up the components 202-208. The bandgap reference block 104 thereafter begins generating and outputting the one or more output signals 200.

At act 410, a determination is made as to whether to deactivate the bandgap reference block 104. For example, the bandgap reference block 104 may be deactivated where a power-up signal is no longer received at a gate connection of a MOSFET in the switching circuit 210. If the power-up signal is still being received (410 NO), then the process 400 returns to act 410. Otherwise, if a power-up signal is no longer being received (410 YES), then the process 400 continues to act 412.

At act 412, the switching circuit 210 is controlled to deactivate the bandgap reference block 104. For example, the switching circuit 210 may transition from a closed and conducting position to an open and non-conducting position, thereby interrupting a conductive path between the voltage rail 102 and the reference node 212 and powering down the components 202-208. The process 400 then returns to act 404.

Accordingly, the process 400 may be executed to control operation of the bandgap reference block 104. While the bandgap reference block 104 is in an active mode (for example, when a power-up signal is received at the switching circuit 210), the switching circuit 210 is in a closed and conducting position. A conductive path is formed from the voltage rail 102 to the reference node 212, such that the components 202-208 are powered up. While the components 202-208 are powered up, one or more output signals 200 are generated and output to one or more components, including the high-voltage LDO regulator 106 and the PA bias generator 108.

While the bandgap reference block 104 is in a deactive mode (for example, when a power-up signal is not received at the switching circuit 210), the switching circuit 210 is in an open and non-conducting position. The conductive path from the voltage rail 102 to the reference node 212 is interrupted, such that only a small leakage current (for example, less than 10 nA) is conducted and the components 202-208 are powered down. While the components 202-208 are powered down, the one or more output signals 200 are no longer generated. However, the components 202-208 remain coupled to the voltage rail 102 and are maintained at a voltage level of the voltage rail 102.

The invention claimed is:

1. A controller having a mode of operation including one of an on mode and an off mode, the controller including:

a voltage rail node;

a reference node;

a power amplifier;

a low-dropout regulator;

at least one powered component including one or more of a bandgap reference core, an error amplifier, and a bias voltage generator, the at least one powered component configured to generate a bandgap voltage signal based on a rail voltage at the voltage rail node, generate one or more of the bandgap voltage signal, a power amplifier bias signal, and a regulator bias current signal, and provide the power amplifier bias signal to the power amplifier, the regulator bias current signal to the low-dropout regulator, and the bandgap voltage signal to the power amplifier and the low-dropout regulator; and a switching device coupled in series between the reference node and the at least one powered component and configured to provide a conductive path through the at least one powered component from the voltage rail node to the reference node in response to the controller being in the on mode, and to interrupt the conductive path through the at least one powered component in response to the controller being in the off mode.

2. The controller of claim 1 wherein the at least one powered component is coupled between the switching device and the voltage rail node.

3. The controller of claim 1 wherein the switching device is further configured to maintain the at least one powered component at the rail voltage in the off mode.

4. The controller of claim 3 wherein the switching device includes a metal-oxide semiconductor field-effect transistor (MOSFET).

5. The controller of claim 4 wherein the MOSFET includes a drain coupled to the at least one powered component, a source coupled to the reference node, and a gate to receive a signal indicative of the mode of operation of the controller.

6. The controller of claim 5 wherein the MOSFET is configured to conduct a leakage current of less than 10 nA in the off mode.

7. The controller of claim 1 wherein the bandgap reference core, the error amplifier, and the bias voltage generator are coupled in parallel.

8. A method of operating a controller having a voltage rail node, a reference node, a power amplifier, a low-dropout regulator, at least one powered component including one or more of a bandgap reference core, an error amplifier, and a bias voltage generator, and a switching device coupled in series between the at least one powered component and the reference node, the method comprising:

receiving a rail voltage at the voltage rail node;

generating, by the at least one powered component, one or more of a bandgap voltage signal, a power amplifier bias signal, and a regulator bias current signal;

providing, by the at least one powered component, the power amplifier bias signal to the power amplifier, the regulator bias current signal to the low-dropout regulator, and the bandgap voltage signal to the power amplifier and the low-dropout regulator;

controlling the switching device to prevent a current from passing through the at least one powered component while the controller is in an off mode;

maintaining the at least one powered component at the rail voltage while the controller is in the off mode; and controlling the switching device to provide a current through the at least one powered component from the voltage rail node to the reference node while the controller is in an on mode.

9. The method of claim 8 wherein the switching device includes a metal-oxide semiconductor field-effect transistor (MOSFET), and wherein controlling the switching device to prevent a current from passing through the at least one powered component while the controller is in the off mode includes controlling the MOSFET to be in an open and non-conducting position.

10. The method of claim 9 wherein controlling the switching device to provide a current through the at least one powered component from the voltage rail node to the reference node while the controller is in the on mode includes controlling the MOSFET to be in a closed and conducting position.

11. The method of claim 9 wherein maintaining the at least one powered component at the rail voltage includes maintaining a connection between the voltage rail node and the at least one powered component while the MOSFET is in the open and non-conducting position.

12. The method of claim 8 further comprising controlling the at least one powered component to generate the bandgap voltage signal based on the rail voltage.

13. The method of claim 12 further comprising providing the bandgap voltage signal to one or more external components.

14. The method of claim 8 wherein controlling the switching device to prevent a current from passing through the at least one powered component includes limiting a leakage current to less than 10 nA.

15. A bandgap reference voltage system comprising:

an input configured to be coupled to a voltage rail node;

a power amplifier;

a low-dropout regulator;

at least one powered component including one or more of a bandgap reference core, an error amplifier, and a bias voltage generator, the at least one powered component configured to generate a bandgap voltage signal based on a rail voltage at the voltage rail node, generate one or more of the bandgap voltage signal, a power amplifier bias signal, and a regulator bias current signal, and provide the power amplifier bias signal to the power amplifier, the regulator bias current signal to the low-dropout regulator, and the bandgap voltage signal to the power amplifier and the low-dropout regulator; and a switching device coupled in series between the at least one powered component and a reference node, and being configured to provide, while in an on mode, a conductive path through the at least one powered component from the voltage rail node to the reference node, and interrupt, while in an off mode, the conductive path through the at least one powered component.

16. The bandgap reference voltage system of claim 15 wherein the switching device includes a metal-oxide semiconductor field-effect transistor (MOSFET), and wherein the MOSFET is configured to be closed and conducting in the on mode and open and non-conducting in the off mode.

* * * * *